US006230469B1

(12) United States Patent
Santa Cruz et al.

(10) Patent No.: US 6,230,469 B1
(45) Date of Patent: May 15, 2001

(54) METHOD FOR BEVELING WALLBOARD PANELS AND INSTALLING SAME TO CREATE A RECESSED FLUSH BUTT-JOINT

(76) Inventors: Cathy D. Santa Cruz, 7630 Tholl Dr., Reno, NV (US) 89506; Wayne R. Sandstrom, P.O. Box 549, Wadsworth, NV (US) 89442

( * ) Notice: Subject to any disclaimer, the term of this patent is extended or adjusted under 35 U.S.C. 154(b) by 0 days.

(21) Appl. No.: 09/481,809

(22) Filed: Jan. 11, 2000

(51) Int. Cl.[7] ..... E04B 1/00; E04G 21/00; E04G 23/00

(52) U.S. Cl. ..... 52/745.2; 52/745.1; 52/489.1; 52/489.2; 52/344

(58) Field of Search ..... 52/344, 489.1, 52/489.2, 745.1, 745.2, 483.1

(56) References Cited

U.S. PATENT DOCUMENTS

| | | | | |
|---|---|---|---|---|
| 1,052,670 | * | 2/1913 | Francis | 52/509 |
| 1,638,280 | * | 8/1927 | Utzman | 52/344 |
| 1,841,757 | * | 1/1932 | Munroe | 52/344 |
| 1,857,534 | * | 5/1932 | Ellis | 52/344 |
| 1,881,420 | * | 10/1932 | Munroe | 52/344 |
| 2,017,266 | * | 10/1935 | Walper | 52/483.1 |
| 2,241,338 | * | 5/1941 | Balduf | 52/344 |
| 2,440,936 | * | 5/1948 | Elmendorf | 52/745.1 |
| 3,357,148 | * | 12/1967 | Turner | 52/489.1 |
| 3,398,982 | * | 8/1968 | Venzie | 52/489.1 |
| 4,117,644 | * | 10/1978 | Weinar | 52/489.2 |
| 4,870,757 | * | 10/1989 | Kirkpatrick | 30/344 |
| 5,473,851 | * | 12/1995 | Northrup, Jr. | 52/513 |
| 5,475,960 | * | 12/1995 | Lindal | 52/478 |
| 5,966,893 | * | 10/1999 | Quillin | 52/713 |

* cited by examiner

*Primary Examiner*—Carl D. Friedman
*Assistant Examiner*—Kevin McDermott

(57) ABSTRACT

A method of transforming a non-beveled edge of a wallboard panel into a beveled edge to form a recessed flush butt joint when installed. This method will not mar or damage the bonded paper coating on the panel and will not interfere with the manufacturers structural strength of the panel.

3 Claims, 2 Drawing Sheets

METHOD FOR BEVELING WALLBOARD PANELS AND INSTALLING SAME TO CREATE A RECESSED FLUSH BUTT-JOINT

FIELD OF THE INVENTION

This invention relates to preparing non-beveled wallboard panel edges before installation in any axis to create a beveled edge when installed and to the installation for adjoining the prepared edges to form substantially a recessed flush butt-joint after tape and compound is applied.

BACKGROUND OF THE INVENTION

Wallboard has become an expensive commodity especially since energy costs have risen in recent years. Wastage factors start at ten percent for standard bi-level homes to fifteen percent for custom-built contemporary homes and ten percent or more for commercial buildings. A big factor in causing this waste is the undesirability of "butt-joints". Butt-joints are non-beveled end joints of wallboard requiring compound to seal the joints, and this compound is noticeable to the end user and is most unsightly and very undesirable. Unfortunately, the resulting joint is very difficult to conceal and even a highly skilled professional has a difficult time hiding such a joint. Also, tons of material is thrown out each year because it is too short and this is not at all economical as the cost of disposing of waste is escalating.

Furthermore, building materials expand or contract as the temperature and humidity inside a building change. As the building materials move, tension builds up against the wallboard panels causing ridging or bulging. The tension is relieved as the panels bend outward, usually at the joint. This so-called ridging can occur in regular tapered edge seams, but it is much more common in non-beveled recess butt-joints. Consequently, there is a great need for an economical solution to the aforementioned problems.

There have been numerous attempts within the prior art to resolve the problems associated with creating an aesthetically pleasing, economical and functional recess flush butt-joint but each have inherent disadvantages and drawbacks which the present invention addresses and resolves in a novel, unique manner heretofore not taught.

For example, U.S. Pat. No. 4,920,651 entitled "WALLBOARD BEVELING APPARATUS" teaches a tool having a handle with a rotary blade. This tool is used after the wallboard has been installed and allows a worker to slide the tool along the recess flush butt-joint and bevel the material along the seam. Unfortunately, this is not acceptable because the tool also removes the bonded paper coating leaving the wallboard exposed and this causes many problems. For example this decreases the manufacturer's intended structural strength. Also, it is unlikely that this method or tool would comply with today's strict building and fire codes.

Further prior art includes U.S. Pat. No. 5,079,042 entitled "DRYWALL JOINT FINISHING SYSTEM". Wherein they teach the use of multiple compounds and monofilament fibers which are used to fill in a recess formed within the panel edges. This system is much too costly, is very time consuming and the resultant seam must be covered with a very large amount of finishing compound.

U.S. Pat. Nos. 5,799,458 and 3,675,383 teach a method known as back-blocking which again is not feasible, as this is much to costly and time consuming.

Within all of the known prior art, the resultant seam is very difficult to conceal, thus a large amount of compound is necessary to provide a feathered flush appearance, this becomes most costly and wasteful and is a major disadvantage which the present method addresses and resolves.

SUMMARY OF THE INVENTION

It is therefore an object of the present invention to provide a new method for beveling the edge of a non-beveled wallboard panel which can be easily performed on the job-site by any typical wallboard worker.

Another object of the present invention is to provide a new method for beveling the edge of a non-beveled wallboard panel which is extremely fast, and is therefore not time-consuming.

Yet another object of the present invention is to provide a new method for beveling the edge of a non-beveled wallboard panel which does not mar or damage the bonded paper coating on the wallboard panel in any manner.

Yet another object of the present invention is to provide a new method for installing wallboard panels to create a recessed flush butt-joint which is very easy for the worker to perform.

Still a further object of the present invention is to provide a new method for installing wallboard panels to create a flush butt-joint which is very fast and efficient.

Also another object of the present invention is to provide a new method of installing wallboard panels to create a recessed flush butt-joint which uses much less tape and compound than previous methods and this greatly eliminates unnecessary waste. Thus, this method is extremely economical.

Yet another object of the present invention is to provide a new method of installing wallboard panels to create a recessed flush butt-joint which is aesthetically pleasing as it is substantially seamless in appearance when finished and requires no feathering.

Also another object of the present invention is to provide a new method for installing the wallboard panels to create a recessed flush butt-joint that is strong and will not interfere with the integrity of the wallboard.

Still another object of the present invention is to provide a new method for installing the wallboard panels to create a recessed flush butt-joint which can be installed in different positions having different axes, such as when the wallboard panels are used for ceilings, or the like.

Yet another object of the present invention is to provide a new method for installing the wallboard panels which will not cause unacceptable air pockets as this causes blistering.

A further object of the present invention is to provide a new method of installing wallboard panels to create a recessed flush butt-joint which requires minimal additional tools, other than those typically used within the trade.

Still another object of the present invention is to provide a new method of installing wallboard panels to create a recessed flush butt-joint which reduces drying time when compared to the known prior art.

Also another object of the present invention is to provide a new method of installation which reduces undesirable spalling which is typically incurred within the known prior art and traditional installation of butt-joints.

A very important object of the present invention is to provide a new method of installing wallboard panels to create a recessed flush butt-joint which will comply with today's strict building, safety, and fire codes.

Still another important object is to provide a new method of installing wallboard panels wherein the worker slices a slot within the panel, thus removing some of the gypsum material therein. However, when tape and compound is applied, this slot is filled with compound and replaces the gypsum material which was removed, thereby increasing the overall strength and integrity of the panel which is most advantageous.

Other objects and advantages will be seen when taken into consideration with the following specification and drawings.

DETAILED DESCRIPTION OF THE DRAWINGS

Figure 1:
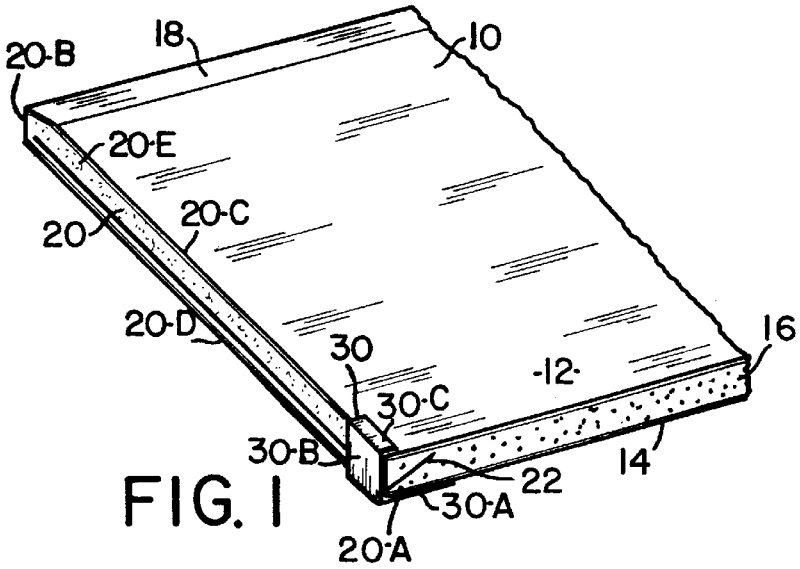
FIG. 1 is substantially a perspective view of a wallboard panel which has been prepared and is ready for installation.

Referring now to the drawings wherein like characters refer to like elements throughout the various views.

FIG. 1 substantially represents a partial perspective view showing a first wallboard panel (10). It is to be understood any suitable wallboard panel of user choice may be used such as the very well known SHEETROCK® panels which are produced and distributed by United States Gypsum company of Chicago, or the like. These type of wallboard panels are typically constructed having a bonded paper covered flat top portion (12) and a bonded paper covered flat bottom portion (14) which in combination sandwich Gypsum material (16) there between. Furthermore, such panels are normally produced having at least one manufactured beveled edge (18).

During the normal installation of these type of wallboards, the worker usually hangs each of the panels in a manner wherein the manufactured beveled edge (18) of each panel are adjacent to one another. Thereafter, when the worker applies tape and compound over the two manufactured edges (18) this creates a flush butt-joint that is very efficient.

Often times the worker must cut the wallboard panel (10) to a desired size and create a custom fit for the job on hand. Unfortunately, the worker may not have a piece of a panel which is of the right size with the manufactured edge (18) in the proper location for mounting. Therefore the worker must cut a new panel and toss the remaining scrap away which is very wasteful and costly. Thus, in order to alleviate this wasteful and costly practice we herein provide a new method for easily forming a beveled edge on a wallboard panel having a non-beveled edge, and this allows a worker to use panels which would otherwise require extensive feathering.

Figure 2:
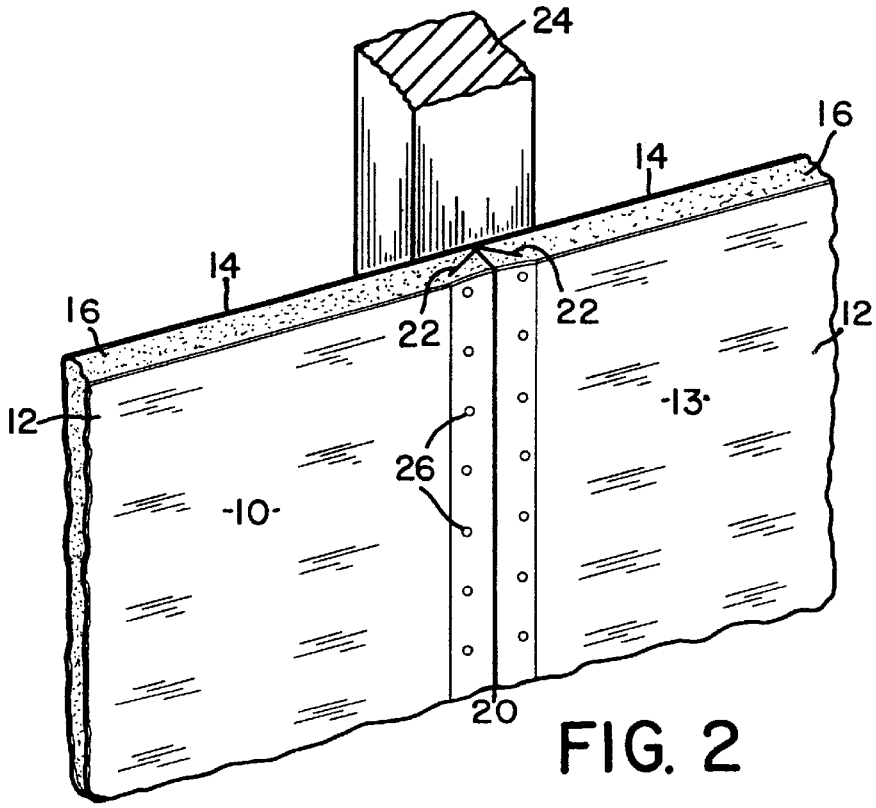
FIG. 2 is substantially a first plan view showing first and second wallboard panels after being installed using the present installation method.

The method of the present invention is exemplified in FIGS. 1 & 2 and includes the following steps:

a. Wherein the worker cuts a first wallboard panel (10) into the desired size and shape in a manner which produces at least one non-beveled squared edge (20). Non-beveled squared edge (20) having a first end (20-A), a second end (20-B), a bonded paper covered flat top portion (20-C), a bonded paper covered flat bottom portion (20-D) and an exposed non-papered edge (20-E). With the exposed non-papered edge (20-E) being substantially at a 90 degree angle to both the top portion (20-C) and the bottom portion (20-D);

b. the worker now positions a cutting instrument next to the first end (20-A) of the non-beveled squared edge (20). It is to be understood any suitable cutting instrument of user choice may be used such as a skill saw, a router, a knife, etc.;

c. inserting the cutting instrument into the non-papered edge (20-E).

d. slicing longitudinally a continuous unwavering slot (22) into non-papered edge (20-E) yet stopping the slicing just prior to engaging second end (20-B) of non-beveled squared edge (20);

e. positioning first wallboard panel (10) into the desired location, such as onto a support stud (24);

f. attaching first wallboard panel (10) in the traditional manner using typical wallboard fasteners (26);

g. cutting a second wallboard panel (13) into the desired size and shape in a manner which produces at least one non-beveled squared edge (20). Non-beveled squared edge (20) having a first end (20-A), a second end (20-B), a bonded paper covered flat top portion (20-C), a bonded paper covered flat bottom portion (20-D) and an exposed non-papered edge (20-E). With the exposed non-papered edge (20-E) being substantially at a 90 degree angle to both the top portion (20-C) and the bottom portion (20-D);

h. the worker now positions a cutting instrument next to the first end (20-A) of the last said non-beveled squared edge (20);

i. inserting the cutting instrument into the last said non-papered edge (20-E).

j. slicing longitudinally a continuous unwavering slot (22) into last said non-papered edge (20-E) yet stopping the slicing just prior to engaging second end (20-B) of last said non-beveled squared edge (20);

k. positioning second wallboard panel (13) substantially next to first wallboard panel (10), thus first wallboard panel (10) and second wallboard panel (13) are substantially aligned side-by-side with the non-papered edge (20-E) of the first wallboard panel (10) being substantially butted up next to the non-papered edge (20-E) of the second wallboard panel (13);

l. attaching second wallboard panel (13) in the traditional manner using typical wallboard fasteners (26);

whereby:

when fasteners (26) are affixed, compression is applied to each non-beveled squared edge (20) causing closure of each slot (22), thus a concave recessed flush butt-joint is automatically formed;

and;

m. applying tape and compound in the traditional manner such as would normally be applied onto manufactures recessed joints.

It is to be noted that if the worker prefers, they may slice along the entire length of non-beveled edge (20), this would cause slot (22) to be continuous having open ends. However, it is contended by the applicants this is not desirable because if the wallboard (10) is cut continuously in this manner with open ends, the wallboard may tend to crack or break when moved for mounting due to gravitational forces. Therefore, we include in step (d) the noted instructions wherein stated "stopping the slicing just prior to engaging second end (20-B)," this then resolves the above noted problem in a manner which is simple and very efficient.

It is to be understood the above method is substantially simplified and additional steps may be included when considering different mounting situations.

Figure 4:
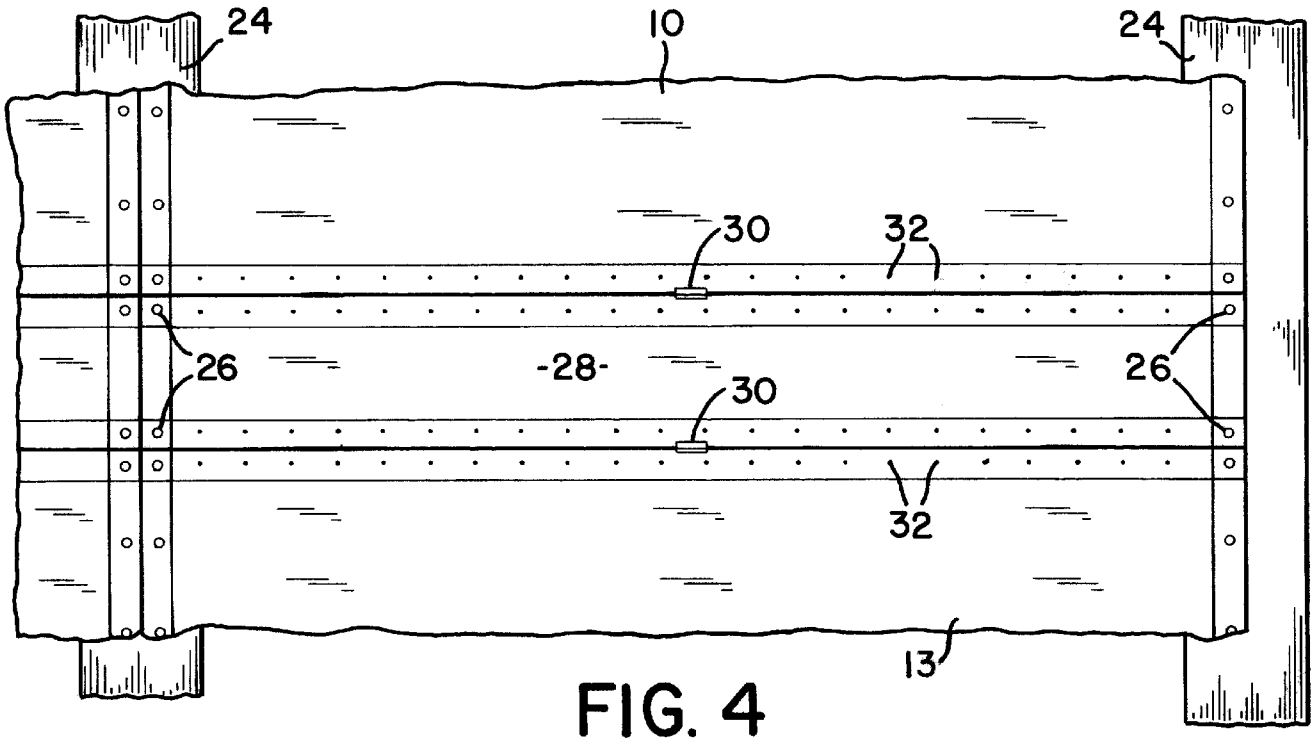
FIG. 4 is substantially a second plan view showing how the present installation method may be used for installing a belly band wallboard.

For example as exemplified within FIG. 4, the worker may need to fill in a space between two pre-mounted wallboards (10 & 13) this is generally known as forming and installing a belly band board (28). Or when a worker is faced with a situation wherein studs (24) are spaced too far apart. In each situation additional reinforcement may be beneficial which will not only provide additional strength but will also eliminate accidental cracking or breaking due to gravitational forces which may be exerted onto the gypsum material surrounding slot (22).

Figure 3:
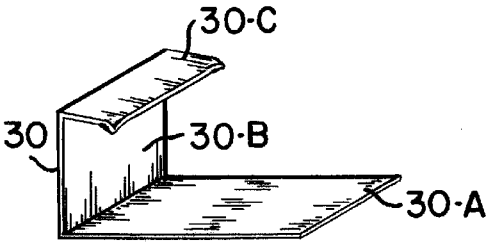
FIG. 3 is substantially a perspective view of a support clip before being mounted on a wallboard panel.

One simple and very efficient reinforcement means for providing additional strength and also eliminating accidental cracking or breaking due to gravitational forces, includes the use of multiple clips (30). It is to be understood any suitable clips of engineering choice may be used, however the applicants find a clip (30) such as illustrated in FIG. 3 is most effective, as this clip is not only easily installed but is also very economical. Thus very little additional time or costs is incurred using such a clip.

Clip (30) substantially comprising: An L-shaped body having a long leg (30-A), a short leg (30-B) and a protruding lip (30-C). Protruding lip (30-C) having slightly curved edges which substantially form and function as teeth, and when installed will bite into the bonded paper coating thus enhancing the friction fit. In use, clip (30) is frictionally attached in the following manner. Protruding lip (30-C) is substantially positioned onto and in contact with bonded paper covered flat top portion (20-C), while short leg (30-B) is positioned onto and in contact with exposed non-papered edge (20-E), and long leg (30-A) is positioned onto and in contact with bonded paper covered flat bottom portion (20-D).

Furthermore, clip (30) can be made from any suitable material of engineering choice such as aluminum or the like. However it is preferable that clip (30) be somewhat flexible, thus if made from a soft bendable steel, such as 20 gauge this is most efficient and cost effective.

As previously noted, additional steps would be incurred if clips (30) are included during installation. For example, the prior defined method steps further include after step (d) and before step (e), the worker grasping a first clip (30) and attaching first clip (30) onto the first end (20-A) of non-beveled squared edge (20) of first wallboard panel (10), and after step (j) and before step (k), the worker grasping a second clip (30) and attaching second clip (30) onto the first end (20-A) of non-beveled squared edge (20) of second wallboard panel (13).

Other method steps may be included when considering the following remarks. It is to be understood within the preferred embodiment, slot (22) should be cut approximately at a 10 degree angle from bonded paper covered flat bottom portion (20-D), and approximately two inches deep using a one eighth inch wide cutting instrument, if the wallboard is five eighths inches thick. This is only exemplary as different workers may find a variant cut is to their individual liking.

It is to be understood, that if the above described angled cut is used, it is unlikely that there will be any resultant air gap or hole which will need to be filled with a compound substance in order to comply with fire and safety codes. However, if required or if a different cut is used, then the method steps would further include after step "l" and before step "m", rolling an instrument similar to a tracing wheel, along the concave butt-joint in a manner which forms regular spaced apart fill holes (32) which are in open communication with slot (22). Whereby, when step "m" is completed, the compound will automatically fill slot (22) through fill holes (32) and eliminate any air pockets and also increase strength. In fact, this method produces a recessed flush butt-joint which is stronger than the manufacturers finished butt-joint when the manufacturers beveled edges are used.

Although the invention has been herein shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus's.

Having described our invention, what we claim as new and desire to secure by Letters Patent is:

1. A method for beveling the edge of a first and a second wallboard panel including installation for creating a recessed flush butt joint comprising the following steps:

a. cutting a first wallboard panel in a manner which produces at least one non-beveled squared edge having a first end, a second end, a bonded paper covered flat top portion, a bonded paper covered flat bottom portion and an exposed non-papered edge, with said non-papered edge being substantially at a 90 degree angle to both said top portion and said bottom portion;

b. positioning a cutting instrument next to said first end of said non-beveled squared edge;

c. inserting said cutting instrument into said non-papered edge;

d. slicing longitudinally a continuous unwavering slot into said non-papered edge, but stopping the slicing just prior to engaging said second end of said non-beveled squared edge;

e. positioning said first wallboard panel into the desired location;

f. attaching said first wallboard panel to stud supports using fasteners;

g. cutting a second wallboard panel into the desired size and shape in a manner which produces at least one non-beveled squared edge having a first end, a second end, a bonded paper covered flat top portion, a bonded paper covered flat bottom portion and an exposed non-papered edge, with said non-papered edge being substantially at a 90 degree angle to both said top portion and said bottom portion;

h. positioning said cutting instrument next to said first end of said non-beveled squared edge;

i. inserting said cutting instrument into said non-papered edge;

j. slicing longitudinally a continuous unwavering slot into said non-papered edge, but stopping the slicing just prior to engaging the second end of said non-beveled edge;

k. positioning said second wallboard panel next to said first wallboard panel, thus said first wallboard panel and said second wallboard panel are substantially aligned side-by-side with said non-papered edge of said first panel being substantially butted up next to said non-papered edge of said second panel;

l. attaching said second wallboard panel to stud supports using fasteners;

whereby:

when said fasteners are affixed, compression is applied to each said non-beveled squared edge causing closure of each said slot, thus a concave recessed flush butt joint is automatically formed;

and;

m. applying tape and compound.

2. A method for beveling the edge of a first and a second wallboard panel including installation for creating a recessed flush butt joint comprising the following steps:

a. cutting a first wallboard panel in a manner which produces at least one non-beveled squared edge having a first end, a second end, a bonded paper covered flat top portion, a bonded paper covered flat bottom portion and an exposed non-papered edge, with said non-papered edge being substantially at a 90 degree angle to both said top portion and said bottom portion;

b. positioning a cutting instrument next to said first end of said non-beveled squared edge;

c. inserting said cutting instrument into said non-papered edge;

d. slicing longitudinally a continuous unwavering slot into said non-papered edge, but stopping the slicing just prior to engaging said second end of said non-beveled squared edge;

e. attaching a first clip onto said first end of said non-beveled squared edge of said first wallboard panel.

f. positioning said first wallboard panel into the desired location;

g. attaching said first wallboard panel to stud supports using fasteners;

h. cutting a second wallboard panel in a manner which produces at least one non-beveled squared edge having a first end, a second end, a bonded paper covered flat top portion, a bonded paper covered flat bottom portion and an exposed non-papered edge, with said non-papered edge being substantially at a 90 degree angle to both said top portion and said bottom portion;

i. positioning said cutting instrument next to said first end of said non-beveled squared edge;

j. inserting said cutting instrument into said non-papered edge;

k. slicing longitudinally a continuous unwavering slot into said non-papered edge, but stopping the slicing just prior to engaging the second end of said non-beveled edge;

l. attaching second clip onto said first end of said non-beveled squared edge of said second wallboard panel;

m. positioning said second wallboard panel next to said first wallboard panel, thus said first wallboard panel and said second wallboard panel are substantially aligned side-by-side with said non-papered edge of said first panel being substantially butted up next to said non-papered edge of said second panel;

n. attaching said second wallboard panel to stud supports using fasteners;

whereby:

when said fasteners are affixed, compression is applied to each said non-beveled squared edge causing closure of each said slot, thus a concave recessed flush butt joint is automatically formed;

and;

o. applying tape and compound.

3. The method of claim 1 wherein each said non-beveled squared edge is five-eighths of an inch thick and each said slot is two inches deep.

* * * * *